US007588239B2

(12) United States Patent
Marcinik et al.

(10) Patent No.: US 7,588,239 B2
(45) Date of Patent: Sep. 15, 2009

(54) TRANSPORT AND ALIGNMENT SYSTEM

(75) Inventors: Robert F. Marcinik, Wallkill, NY (US); Daniel J. Williams, Woodbury, CT (US); Xavier A. Padros, New Milford, CT (US)

(73) Assignee: Pitney Bowes Inc., Stamford, CT (US)

( * ) Notice: Subject to any disclaimer, the term of this patent is extended or adjusted under 35 U.S.C. 154(b) by 526 days.

(21) Appl. No.: 11/300,260

(22) Filed: Dec. 14, 2005

(65) Prior Publication Data

US 2007/0132178 A1 Jun. 14, 2007

(51) Int. Cl.

| | |
|---|---|
| ***B65H 37/04*** | (2006.01) |
| ***B65H 9/06*** | (2006.01) |
| ***B65G 15/14*** | (2006.01) |
| ***B65G 47/31*** | (2006.01) |

(52) U.S. Cl. ..... 270/52.18; 270/52.14; 270/52.16; 270/52.19; 270/58.29; 271/243; 271/233; 271/234; 198/412; 198/817; 198/415; 198/461.3; 198/604; 198/737; 198/726; 198/741; 198/728

(58) Field of Classification Search ..... 270/52.14, 270/52.16, 52.18, 52.19, 58.29; 271/202, 271/203, 264, 198, 275, 243, 233, 234; 198/412, 198/415, 726, 728, 817, 737, 741, 461.3, 198/604

See application file for complete search history.

(56) References Cited

U.S. PATENT DOCUMENTS

| | | | | |
|---|---|---|---|---|
| 3,153,533 | A * | 10/1964 | Novick | 271/2 |
| 3,283,882 | A * | 11/1966 | Conrad | 198/817 |
| 3,558,125 | A * | 1/1971 | Aaron et al. | 271/279 |
| 5,067,697 | A * | 11/1991 | Honegger | 270/37 |
| 5,074,544 | A * | 12/1991 | Kulpa et al. | 271/225 |
| 6,164,640 | A | 12/2000 | Stengl et al. | 271/187 |
| 6,293,544 | B1 * | 9/2001 | Fedinatz | 271/243 |
| 6,367,794 | B1 | 4/2002 | Godwin | 270/58.26 |
| 6,386,537 | B1 * | 5/2002 | Howard et al. | 271/303 |
| 6,663,104 | B2 * | 12/2003 | DaCunha et al. | 271/241 |

FOREIGN PATENT DOCUMENTS

| | | | |
|---|---|---|---|
| DE | 10126114 | A1 | 12/2002 |
| EP | 1231168 | A1 | 8/2002 |
| EP | 1410992 | A1 | 4/2004 |

* cited by examiner

*Primary Examiner*—Gene Crawford
*Assistant Examiner*—Leslie A Nicholson, III
(74) *Attorney, Agent, or Firm*—Brian A. Collins; Angelo N. Chaclas

(57) ABSTRACT

A transport and alignment system is provided for handling stacked sheet material on a support deck including first and second belts each having a portion thereof disposed parallel to the support deck. Each of the belts includes a plurality of spaced-apart fingers which engage the edges of the stacked sheet material and define a pocket therebetween. The transport and alignment system further includes a drive mechanism for independently driving the first and second belts to effect concurrent and relative motion of the fingers. Concurrent motion of the fingers transports the stacked sheet material along the support deck while relative motion of the fingers opposed edges of the stacked sheets of material. The transport and alignment system is described in the context of a stitcher and chassis module of a mailpiece inserter.

15 Claims, 6 Drawing Sheets

TRANSPORT AND ALIGNMENT SYSTEM

FIELD OF THE INVENTION

The present invention relates to apparatus for conveying stacked sheets of material, and more particularly, to an apparatus for aligning the peripheral edges of a multi-sheet stack while being conveyed on a transport deck such as those employed at used in high volume mail piece inserter systems.

BACKGROUND OF THE INVENTION

Various apparatus are employed for arranging sheet material in a package suitable for use or sale in commerce. One such apparatus, useful for describing the teachings of the present invention, is a mail piece inserter system employed in the fabrication of high volume mail communications, e.g., mass mailings. Such mailpiece inserter systems are typically used by organizations such as banks, insurance companies and utility companies for producing a large volume of specific mail communications where the contents of each mailpiece are directed to a particular addressee. Also, other organizations, such as direct mailers, use mail inserters for producing mass mailings where the contents of each mail piece are substantially identical with respect to each addressee. Examples of inserter systems are the 8 series, 9 series, and APS™ inserter systems available from Pitney Bowes Inc. located in Stamford, Conn., USA.

In many respects, a typical inserter system resembles a manufacturing assembly line. Sheets and other raw materials (i.e., a web of paper stock, enclosures, and envelopes) enter the inserter system as inputs. Various modules or workstations in the inserter system work cooperatively to process the sheets until a finished mail piece is produced. The precise configuration of each inserter system depends upon the needs of each customer or installation.

Typically, inserter systems prepare mail pieces by arranging preprinted sheets of material into a collation, i.e., the content material of the mail piece, on a transport deck. The collation of preprinted sheet may continue to a chassis module where additional sheets or inserts may be added to a targeted audience of mail piece recipients. From the chassis module the fully developed collation may continue to a stitcher module where the sheet material may be stitched, stapled or otherwise bound. Subsequently, the bound collation is typically folded and placed into envelopes. Once filled, the envelopes are conveyed to yet other stations for further processing. That is, the envelopes may be closed, sealed, weighed, sorted and stacked. Additionally, the inserter may include a postage meter for applying postage indicia based upon the weight and/or size of the mail piece.

The mail piece collation may comprise several individualized documents, i.e., specific to a mail piece addressee, and/or one or more preprinted inserts which may be specifically tailored to the addressee. Generally, a barcode system is employed to command various sheet feeding mechanisms (i.e., one of the components of the chassis module mentioned in the preceding paragraph) to feed/add a particular insert to a collation. Of course, the mail piece collation may comprise any combination of sheet material whether they include personalized documents, preprinted inserts or a combination thereof.

FIGS. 1*a*-1*c* show the relevant components of a prior art chassis module/station 100 of an inserter system. The figures show the chassis module 100 conveying a sheet material 112 along a transport deck 114 (omitted from FIG. 1*a* to reveal underlying components). The transport deck 114 includes a drive mechanism 116 for displacing the sheet material 112 as it slides over the transport deck 114. In FIG. 1*c*, the transport deck 114 includes a low friction surface 114S having a pair of parallel grooves or slots 114G formed therein. Riding in the grooves or through the slots 114G are fingers 116F which extend orthogonally from the surface 114S of the deck 114.

Referring to FIGS. 1*a*-1*c*, the fingers 116F are driven by a belt or chain $\mathbf{118}_{C1}$ which, in turn, wraps around a drive sprocket or gear 118G. Furthermore, the fingers $\mathbf{116}F_1$ are spaced in equal length increments while the fingers $\mathbf{116}F_2$, of adjacent chains $\mathbf{118}_{C1}$, $\mathbf{118}_{C2}$ are substantially aligned, i.e., laterally across the transport deck 114. As such, a substantially rectangular region or pocket is established between the fingers $\mathbf{116}F_1$, $\mathbf{116}F_2$.

Above the transport deck 114 are one or more feeder mechanisms 120A, 120B (two are shown for illustration purposes) which are capable of feeding inserts 122, i.e., sheet material, to the transport deck 114. The inserts 122 may be laid to build a collation 112 or may be added to the sheet material 112 (i.e., a partial collation) initiated upstream of the transport deck 114. A controller (not shown) issues command signals to the feeder mechanisms 120A. 120B to appropriately time the feed sequence such that the inserts 122 are laid in the rectangular region 124 between the fingers $\mathbf{116}F_1$, $\mathbf{116}F_2$. More specifically, as each pair of lateral fingers $\mathbf{116}F_1$, $\mathbf{116}F_2$ is driven within the grooves or slots 144G, one edge of the sheet material 112 is engaged to slide the collation 112 along the transport deck 114. As the sheet material 112 passes below the feeding mechanisms 120A, 120B, other sheets or inserts 122 are added. At the end of the transport deck 114, the fingers $\mathbf{116}F_1$, $\mathbf{116}F_2$ drop beneath the transport deck 114 such that the collation (i.e., the combination of the sheet material and inserts 122) may proceed to subsequent processing stations.

While the drive mechanism 116 of the prior art provides rapid transport of collated sheet material 112, 122 and has proven to be effective and reliable, sheets or inserts 122 fed by the feeding mechanisms 120A, 120B can become misaligned in the rectangular space or pocket 124 provided between the fingers $\mathbf{116}F_1$, $\mathbf{116}F_2$. That is, inasmuch as the pocket 124 is oversized to accept the sheets or inserts 122, the inserts 122 can become misaligned due to a lack of positive registration surfaces on all sides of the collation 112, 122.

Various mechanisms are employed to vary the pocket size, i.e., sometimes referred to as the "pitch", between the chassis fingers. The ability to change pitch not only enables greater efficiency, i.e., a greater number of pockets for inserts, but also minimizes the misalignment of inserts being laid on a collation. Notwithstanding the ability to minimize pocket size, it will be appreciated that without positive restraint on all free edges of the collation, individual sheets or inserts will be misaligned. Consequently, prior art inserters commonly employ complex registration mechanisms or jogging devices to align the free edges of a collation. For example, inserters may employ a series of swing arms which pivot onto the transport deck, i.e., into the conveyance path of the collation. The swing arms engage and align the leading edge of a collation, i.e., the edge opposite the fingers. While the swing arms effectively maintain alignment of the collation, the mechanical complexity associated with the pivoting mechanism is a regular source of maintenance, jamming or failure.

In the absence of such swing arms, an inserter may employ other jogging mechanisms downstream of the chassis module to align the edges of the collation. That is, before subsequent processing, e.g., stitching or enveloping, the edges of the collation are aligned to: (i) ensure that stitching does not result in permanent misalignment of the collation or (ii) provide a smooth transition and/or snug fit within a mailing envelope. Such jogging mechanisms often employ a complex arrangement of solenoid activated stops which tap or "jog" each edge by a predetermined displacement with each motion of the stop. By jogging the stops several times, the edges of the collation are aligned. Like the swing arm mechanisms described above, the jogging mechanisms are highly complex and prone to increased maintenance, jamming and failure.

A need, therefore, exists for a transport and alignment system which eliminates mechanical complexity, enhances reliability and minimizes maintenance.

SUMMARY OF THE INVENTION

A transport and alignment system is provided for handling stacked sheet material on a support deck including first and second belts each having a portion thereof disposed parallel to the support deck. Each of the belts includes a plurality of spaced-apart fingers which engage the edges of the stacked sheet material and define a pocket therebetween. The transport and alignment system further includes a drive mechanism for independently driving the first and second belts to effect concurrent and relative motion of the fingers. Concurrent motion of the fingers transports the stacked sheet material along the support deck while relative motion of the fingers aligns opposed edges of the stacked sheets of material. The transport and alignment system is described in the context of a stitcher and chassis module of a mailpiece inserter.

BRIEF DESCRIPTION OF THE DRAWINGS

Further details of the present invention are provided in the accompanying drawings, detailed description, and claims.

DETAILED DESCRIPTION

The invention will be described in the context of a mail piece inserter for processing mail communications and, more specifically, in the context of two modules thereof, i.e., a stitcher module and a chassis module. While the invention may be particularly useful for processing/producing mail communications, it should be appreciated that the transport and alignment system of the present invention is broadly applicable to any apparatus/system which requires the transport and alignment of stacked sheets of material.

Figure 1A:
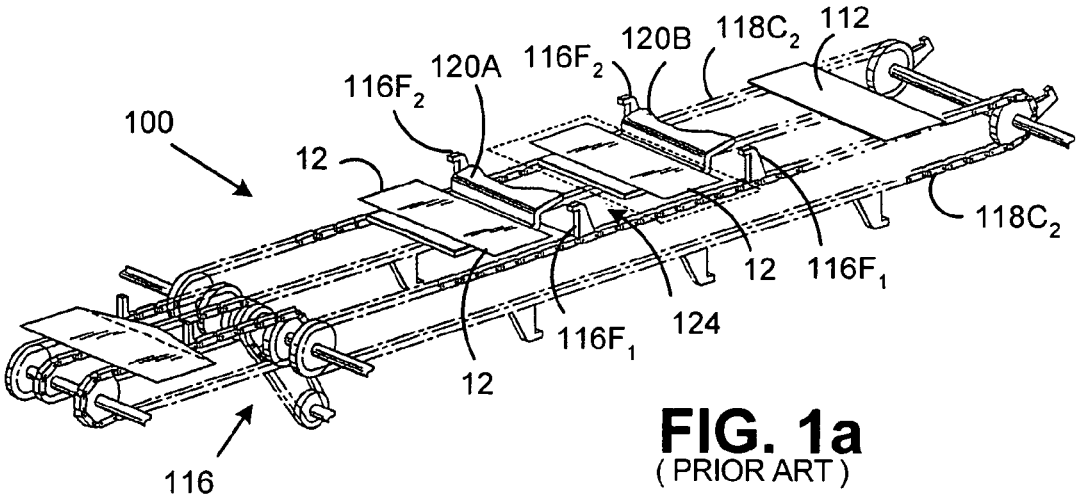
FIG. 1a ( PRIOR ART )
FIG. 1*a* is a perspective view of a prior art chassis drive mechanism employed in a mail piece inserter system.
Figure 1B:
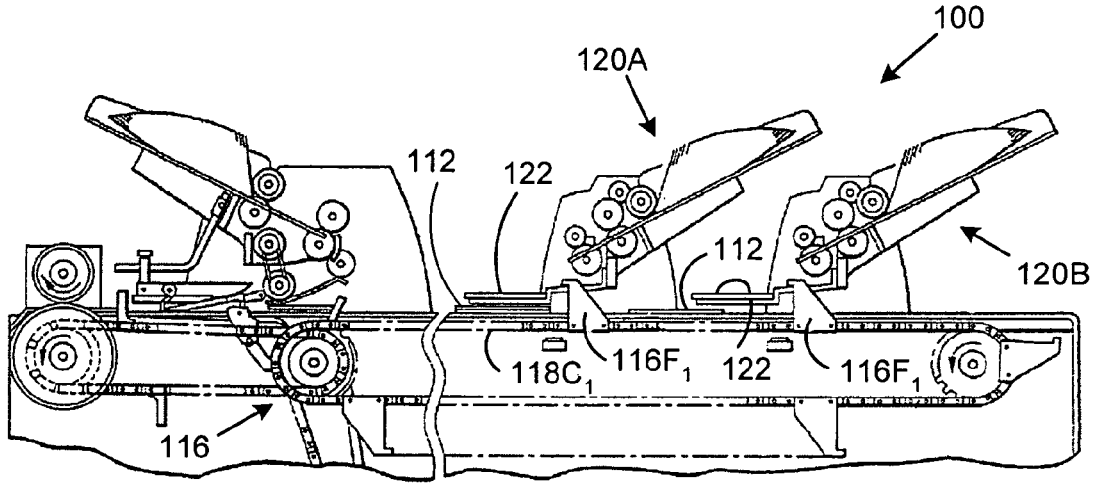
FIG. 1b ( PRIOR ART )
FIG. 1*b* is a profile view of the prior art chassis drive mechanism shown in FIG. 1*a* including feed mechanisms for building a sheet material collation.
Figure 1C:
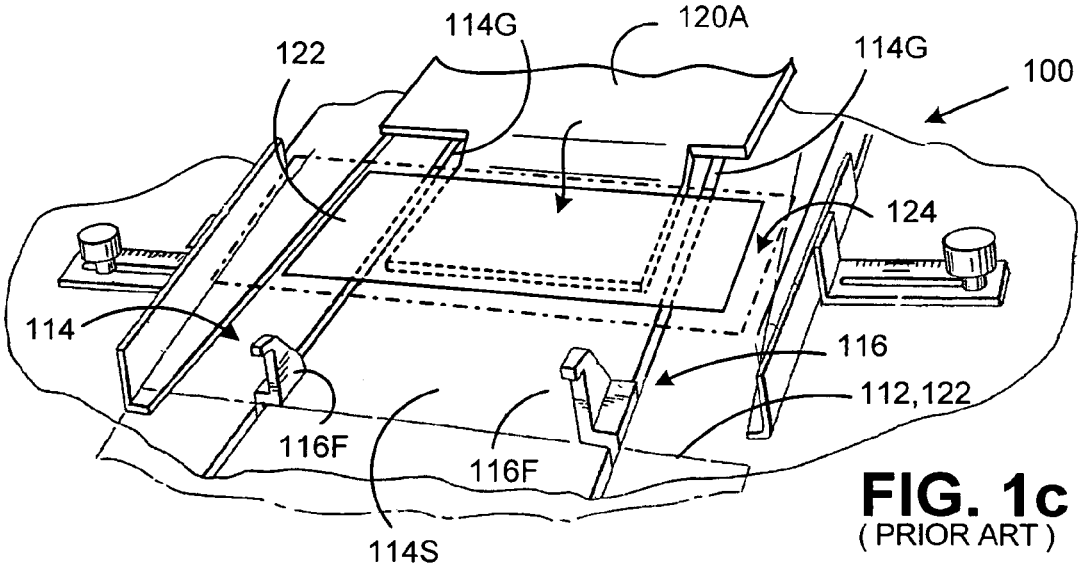
FIG. 1c ( PRIOR ART )
FIG. 1*c* is a broken-away isometric view of the prior art chassis drive mechanism of FIG. 1*a* to more clearly show chain driven fingers for conveying the sheet material collation along a transport deck.
Figure 2:
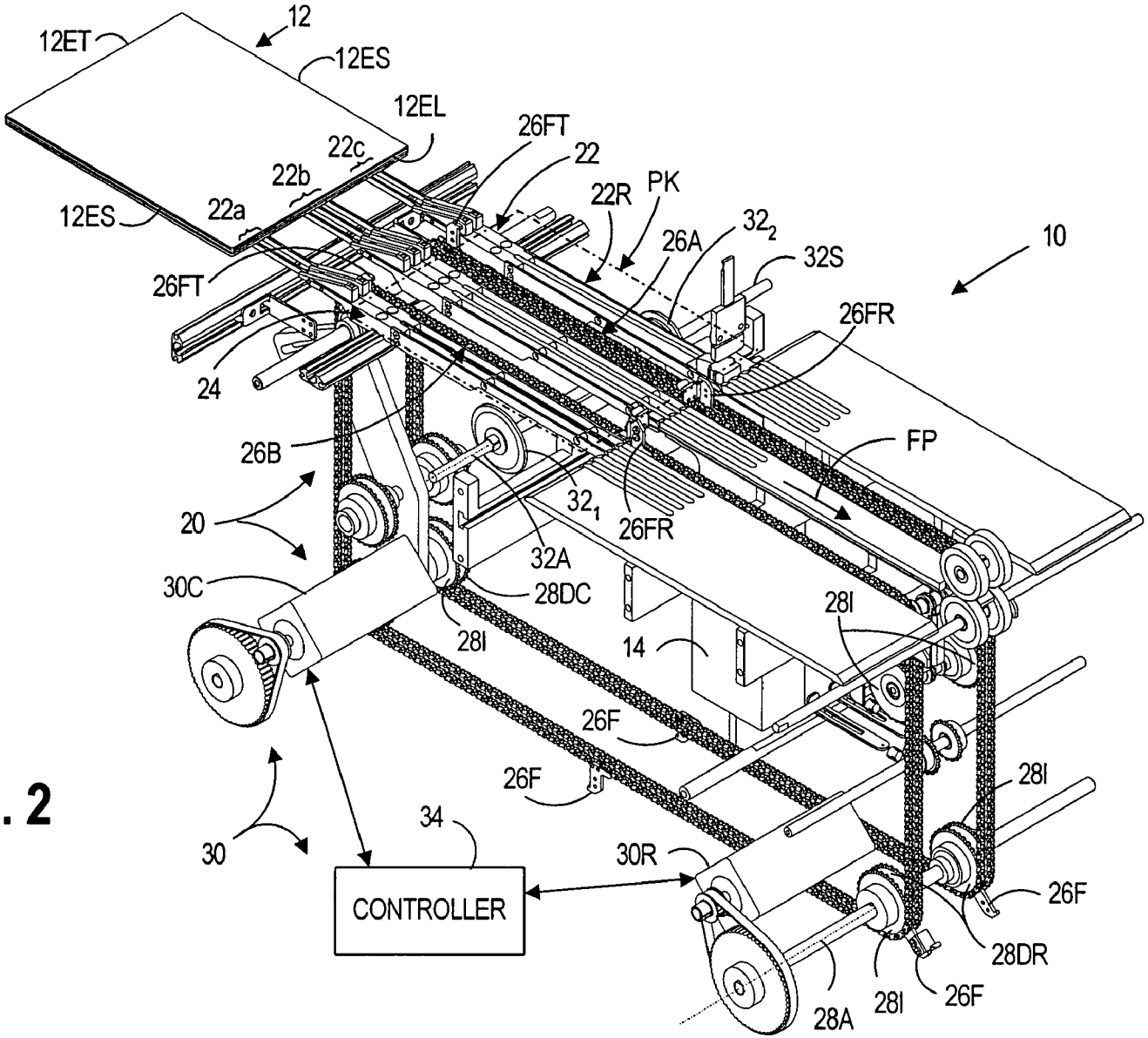
FIG. 2 is an isometric view of a transport and alignment system according to the present invention including conveyor and registration chains capable of independent relative motion.
Figure 2A:
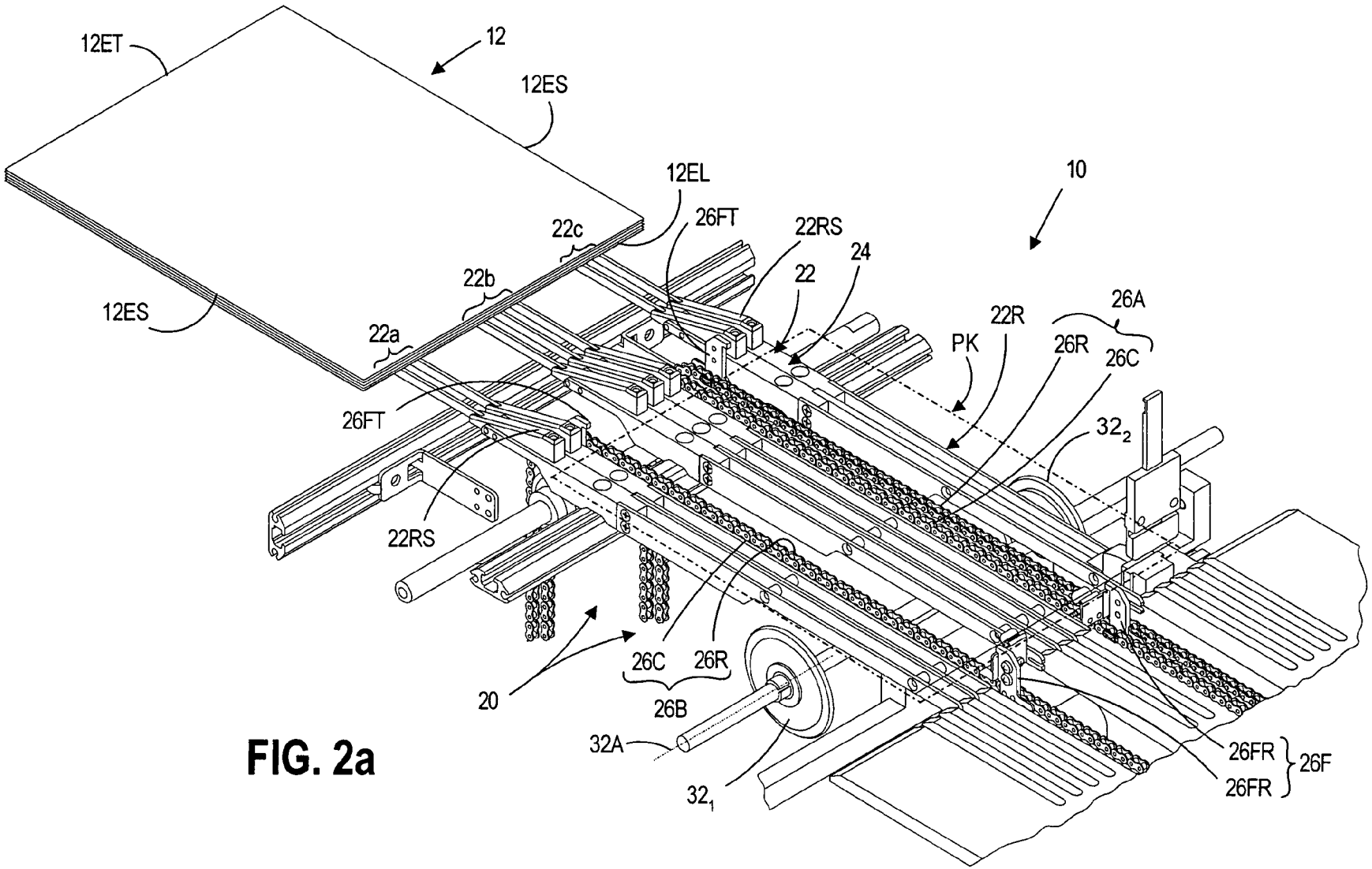
FIG. 2*a* is an enlarged view of the conveyor and registration chains shown in FIG. 2*a* including a plurality of spaced-apart fingers for accepting, transporting and aligning opposed edges of a collation of sheet material.
Figure 3:
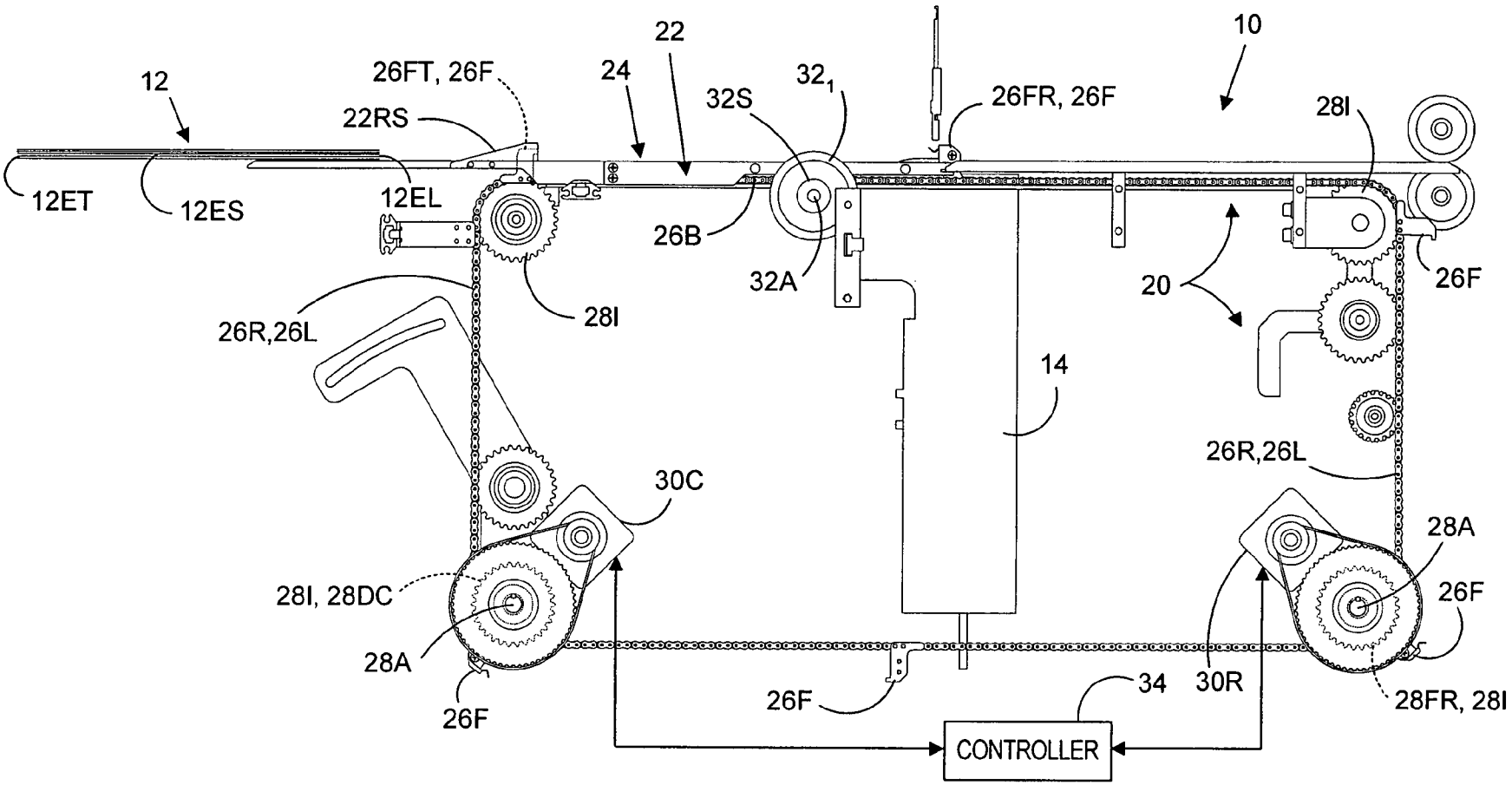
FIG. 3 is a partially broken-away profile view of the transport and alignment system shown in FIG. 2*a*.

In FIGS. 2, 2*a* and 3, a stitcher module 10 of a mailpiece inserter includes a transport and alignment system 20 according to the present invention. The transport and alignment system 20 includes a plurality of longitudinal supports 22 and ribs 22R which are coupled, both longitudinally and laterally, to define substantially planar support deck 24. In the described embodiment, three groups of longitudinal supports 22*a*, 22*b* and 22*c* are shown for a total of seven (7), however, there may be a fewer or greater number of supports 22 (and associated ribs 22R) depending upon the desired stiffness of the support deck 24. Further, the size of the support deck 24 generally corresponds to the size and shape of a collation of sheet material 12 to be laid and processed thereon.

Interposing the supports 22*a*, 22*b*, 22*c*, are two (2) pairs of drive belts or chains 26A, 26B, each pair including a conveyor drive chain 26C and a registration chain 26R. In the context used herein, the terms "chain" and "belt" are used interchangeably in the specification and appended claims to mean any flexible chord, fiber matrix, cable, rope, or connecting links which may be frictionally or positively driven under tension by/over a drive mechanism. The conveyor and registrations chains 26C, 26R are driven by a mechanism including drive and idler wheels or sprockets 28D, 28I which are rotationally mounted to the support frame of the stitcher 10. In the context used herein the terms "sprockets" or "wheels" are used interchangeably to mean any circular or cylindrical element or member capable of engaging, i.e., driving or supporting, a chain or belt.

To more clearly view the chains 26C, 26R and sprockets 28D, 28I, FIGS. 2*a*, and 2*b* omit various longitudinal and lateral cross members of the support frame. While the conveyor and registration chains 26C, 26R may be disposed about as few as two (2) sprockets, i.e., one drive sprocket 28DC or 28DR and one idler sprocket 28I, to form an elliptically-shaped chain configuration, the described embodiment includes four (4) sprockets, i.e., one drive sprocket, 28DC or 28DR, and three (3) idler sprockets 28I to define a four-sided, polygon-shaped, chain configuration (best seen in FIG. 3). Furthermore, the drive and idler sprockets 28DC, 28DR, 28I are positioned such that a portion of each of the conveyor and registration chains 26C, 26R is parallel to and/or co-planar with the support deck 24. That is, one leg or side of the polygon-shaped chains 26C, 26R is disposed parallel to the plane of the support deck 24.

In the illustrated embodiment, the drive sprocket 28DC of the conveyor drive chain 26C shares a common rotational axis 28A with an idler sprocket 28IR of the registration chain 26R and visa-versa. Furthermore, the drive sprocket 28DC of the conveyor drive chain 26C is disposed at one corner of the polygon-shaped chains 26C, 26R while the drive sprocket 28DR of the registration chain 26R is disposed at another corner. By sharing axes 28A, the requirement for multiple support shafts is eliminated, thereby reducing mechanical complexity.

The drive mechanism 30 includes a pair of drive motors 30C, 30R and a controller 34. The drive motors 30C, 30R are mounted to the support frame (not shown) of the stitcher 10 and drive the conveyor and registration chains 26C, 26R. More specifically, a first drive motor 30C is rotationally coupled to each of the conveyor drive sprockets 28DC and a second drive motor 30R is rotationally coupled to each of the registration drive sprockets 28DR. Each of the drive motors 30C, 30R may be independently driven, e.g., driven at different rotational speeds, to drive the conveyor and registration chains 26C, 26R at different operational speeds. The import of such speed variation will become apparent when discussing the operation of the inventive transport and alignment system 20.

The conveyor drive and registration chains 26C, 26R each include a plurality of fingers 26F extending orthogonally from the respective chain i.e., from the direction of motion. From another frame of reference, the fingers 26F project through and are perpendicular to the plane of the support deck 24. Each conveyor drive chain 26C includes a plurality of transport fingers 26FT, equally-spaced along its length, while each registration chain 26R similarly includes a plurality of equally-spaced registration fingers 26FR. The transport and registration fingers 26FT, 26FR are staggered, i.e., not aligned, to define a space or pocket therebetween, which, as will be more fully understood when discussing the system operation, will be determined based upon the size of the collated or stacked sheet material 12.

Inasmuch as the described embodiment of the transport and alignment system 20 employs two pairs of chains 26A, 26B, the pocket between the transport and registration fingers 26FT, 26FR may be viewed as defining a four-sided rectangle or polygon. More specifically, the transport fingers 26FT of the conveyor drive chains 26C are laterally aligned, i.e., across the support deck 24, to define one side of the polygon. The registration fingers 26FR of the registration chains 26R are laterally aligned to define an opposing side of the polygon. Finally, the adjacent sides of the polygon are defined by registration walls (not shown) which are parallel to, and outboard of, the chains 26A, 26*b*.

In operation, a controller 34 issues command signals to the drive motors 30C, 30R to position and regulate the speed of the conveyor drive and registration chains 26C, 26R. Initially, the conveyor drive and registration chains 26C, 26R are positioned such that the spacing between the transport and registration fingers 26FT, 26FR is substantially equal to a corresponding dimension of the collated or stacked sheet material 12. The collated or stacked sheet material 12 is placed into the rectangular pocket PK defined by the fingers 26FT, 26FR of the chains 26A, 26B by sliding the sheet material 12 over ramped surfaces 22RS of the longitudinal supports 22*a*, 22*b*, 22*c*. After the sheet material 12 is deposited, the fingers 26FT, 26FR are positioned by independently controlling the drive motors 30C, 30R to jog and align the opposed edges of the sheet material 12. This first operating mode or step is performed by the controller 34 which commands at least one controlled displacement of either the conveyor drive or registrations chains 26C or 26R i.e., relative displacement of the chains 26C, 26R, to move the fingers 26FT, 26FR closer together. In the preferred embodiment, the controller 34 commands at least one controlled displacement of the conveyor drive chain 26C to move the transport fingers 26FT toward the registration fingers 26FR.

Depending upon the thickness or number of sheets in the collation 12, several oscillations of the fingers 26FT, 26FR may be commanded, drawing the fingers of each pair 26FT, 26FR closer with each oscillation. For example, the transport and registration fingers 26FT, 26FR may be displaced in progressively smaller increments. Initially, the fingers 26FT, 26FR may be displaced a first incremental length e.g., one quarter (¼") inches, while subsequent motions may be commanded which are one half of the prior length, e.g., one eighth (⅛") inches, one sixteenth (1/16") inches and so on.

Figure 4A:
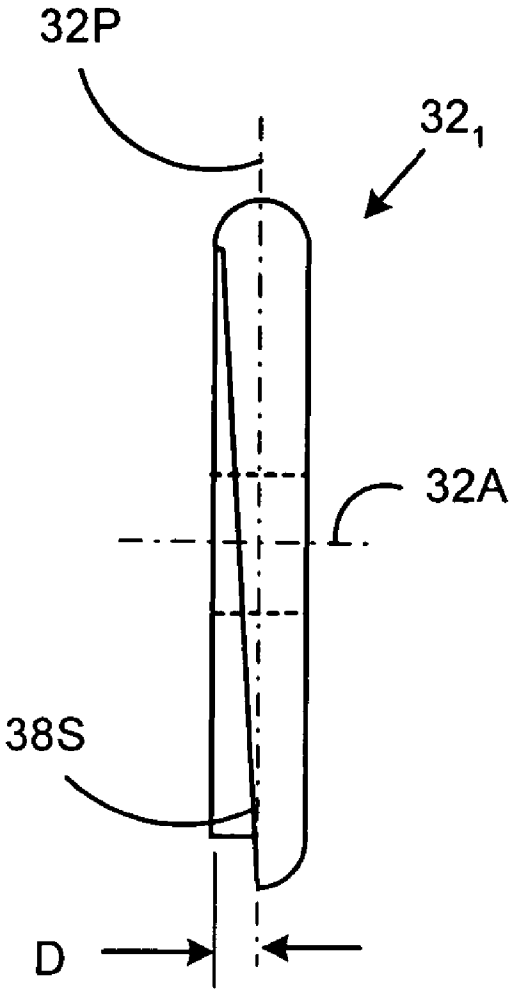
FIG. 4*a* is a profile view of the jogger disc shown in FIG. 4.
Figure 4:
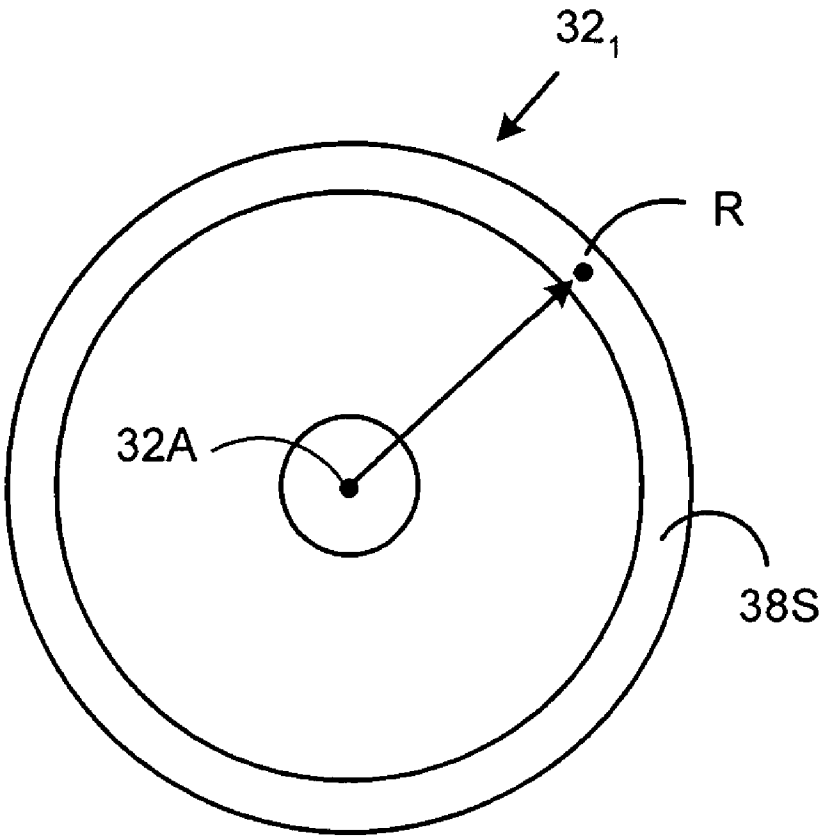
FIG. 4 is a plan view of a jogger disc used in combination with the spaced-apart fingers for aligning a side edge of the sheet material collation.

In FIGS. 2, 4 and 4*a*, a pair of rotating discs $\mathbf{32}_1$, $\mathbf{32}_2$ engage and align the side edges 12ES of the stacked sheet material 12. Such alignment may occur concurrently with, or independent of, the alignment of the opposed leading and trailing edges 12EL, 12ET of the stacked sheet material, i.e., by the relative displacement of the fingers 26FT, 26FR. More specifically, the discs 321, 322 are driven about an axis 32A which is orthogonal to the conveyor drive and registration chains 26C, 26R and parallel to the axes 28A of the drive wheels 28DR or 28DC. Furthermore, at least one of the discs $\mathbf{32}_1$ includes a cam surface 38 (see FIGS. 4 and 4*a*) defined by a ramped or sloping side surface 38S. The sloping side surface 38S may be further defined by the distance D from a point along the side surface 38S to a bifurcating plane 32P of the disc $\mathbf{32}_1$. Moreover, the distance D of all points located at the same radial position R, e.g., same radii, increases or decreases. As such, when the collation 12 contacts the sloping side surface 38S, the side edges 12ES of the stacked sheet material 12 will be displaced inwardly as a consequence of disc rotation. After several revolutions of the disc $\mathbf{32}_1$, the side edges 12ES of the stacked sheet material 12 are jogged and aligned.

One noteworthy advantage of the jogging discs $\mathbf{32}_1$, $\mathbf{32}_2$ relates to the orientation of its rotational axis 32A. That is, inasmuch as the rotational axis 32A is orthogonal and proximal to the conveyor or registration chains 26C, 26R, a simple right angle chain drive (not shown) can be employed to take-off and drive power to the shaft 32S of the discs $\mathbf{32}_1$, $\mathbf{32}_2$. Additionally, to adjust the lateral position of the discs $\mathbf{32}_1$, $\mathbf{32}_2$ (and, consequently, the lateral dimension of the rectangular pocket PK), a simple set-screw (not shown) can be used to position the discs $\mathbf{32}_1$, $\mathbf{32}_2$ along the rotational axis 32A.

Referring again to FIGS. 2, 2*a* and 3, following alignment of the leading, trailing and side edges 12EL, 12ET, 12ES of the sheet material 12, the conveyor drive and registration chains 26C, 26R are driven to position the stacked sheet material 12 over a stitching mechanism 14 (best seen in FIG. 3). While this second operating mode or step may only require a short travel distance, the conveyor drive and registration chains 26C, 26R move concurrently to the correct position. As shown, the stitching mechanism 14 drives a staple or similar element (not shown) through the sheet material 12 to bind the stack. Following the stitching operation, the bound sheet material 12 is transported to subsequent processing stations. That is, the transport and registration fingers 26FT, 26FR move concurrently to transport the bound sheet material 12 along a feed path FP (see FIG. 2) of the support deck 24. Inasmuch as the sheet material 12 has been aligned and bound, no further jogging is required as it travels along the feed path FP. To prevent the bound sheet material 12 from moving to either side, registration walls (not shown) disposed parallel to the feed path FP may be employed to guide the sheet material 12 during transport.

Figure 5A:
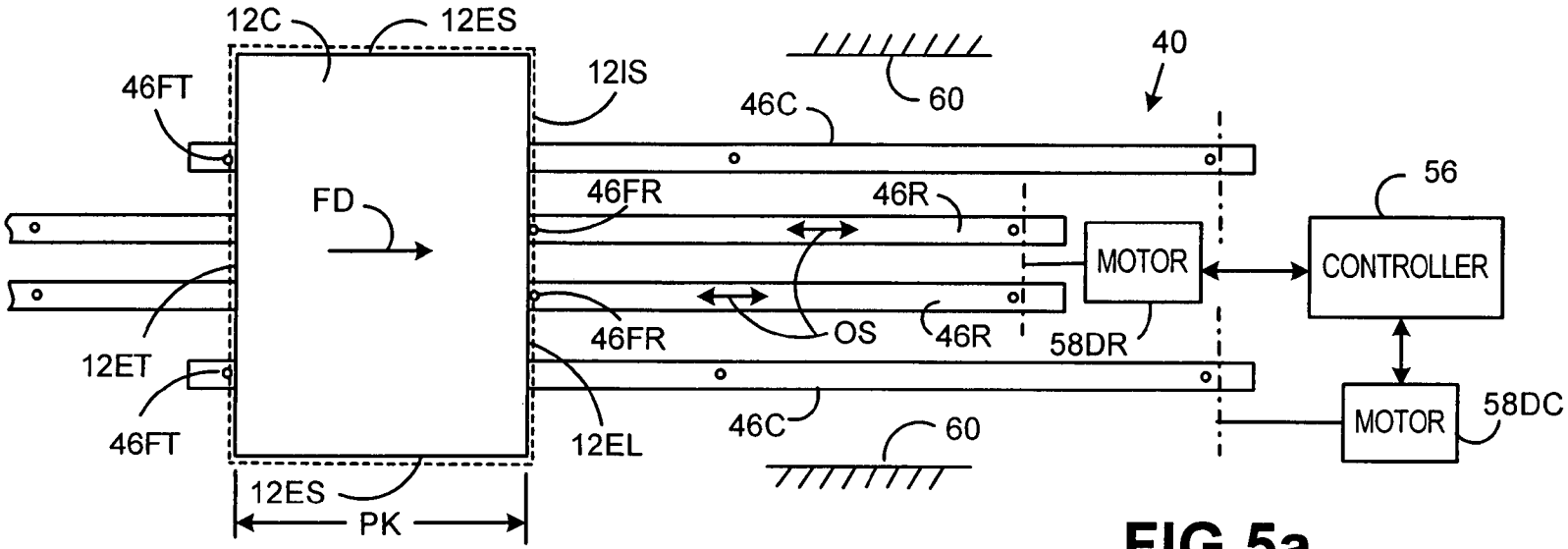
FIG. 5*a* is a schematic top view of the transport and alignment system according to the present invention used in conjunction with a plurality of insert feeders of a mailpiece inserter system.
Figure 5B:
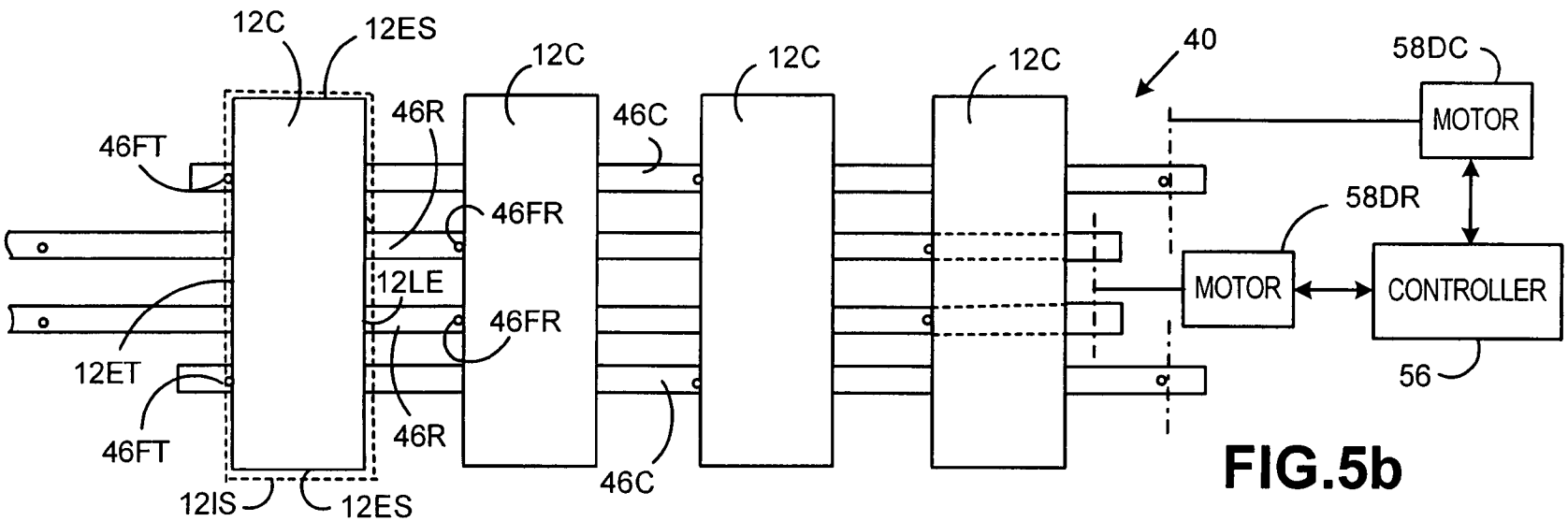
FIG. 5*b* is a schematic top view of the transport and alignment system wherein the transport and registration fingers are positioned out-of-phase to produce multiple pockets.

Another embodiment of the transport and alignment system 20 is shown in FIGS. 5*a* and 5*b* in the context of a chassis module 40. Only the relevant portions of the chassis module 40 are shown to convey the teachings of the invention. As discussed in the background of the invention, the chassis module 40 of an inserter generally serves to add inserts or sheet material to an existing collation. Of course, the chassis module 40 can create a collation simply by placing inserts on a transport deck, but, more commonly, the chassis module 40 adds inserts to preprinted sheet material as it passes beneath various feeder mechanisms (not shown) disposed above the transport deck. In FIG. 5*a*, a top view of the transport and alignment system 20 shows a plurality of laterally spaced conveyor and registration belts 46C, 46R. That is, rather than a conveyor and registration chain forming a working/adjacent pair, the belts 46C, 46R are equally spaced or separated in a lateral direction, i.e., across the chassis module 40 . Furthermore, in this embodiment, the substantially planar configuration of the belts, i.e., flat configuration, enables the belts to dually serve as a support/transport deck and the transport/alignment mechanism. Of course, the use of the belts 46C, 46R in this manner will depend upon the anticipated weight of the sheet material collation and/or the stiffness attainable by the belt construction, i.e., under tensile loading.

Inasmuch as the mechanical components of the drive mechanism, i.e., drive/idler sprockets and drive motor arrangement, can be the same or substantially similar to that previously described, no further/independent discussion of the drive mechanism is necessary with respect its adaptation to the chassis module 40. The principle difference between the two embodiments relates to the control of the drive mechanism and/or control of the conveyor and registration belts 46C, 46R rather than to specific structural differences therebetween.

In operation, sheet material 12 passes beneath several feed mechanisms (not shown) and is disposed between fingers 46FT, 46FR of the conveyor and registration belts 46C, 46R. To transport the sheet material 12, the conveyor and registration belts 46C, 46R move concurrently, i.e., together at the same speed, however, other control motions are superimposed to vary the spacing of the rectangular pocket PK between the fingers 46FT, 46FR. More specifically, a controller 56 drives motors 58DR, 58DC (shown schematically) of the conveyor and registration belts 46C, 46R so as to oscillate the transport and registration fingers 46FT, 46FR. That is, in addition to conveying the collation 12C along a feed direction FD, the controller 56 issues commands to the drive motors 58DR, 58DC to cause the fingers 46FT, 46FR oscillate back and forth in the direction of arrow OS. As such, the fingers 46FT, 46FR move relative to each other to vary the longitudinal spacing or pocket size of the chassis module 40. For example, to facilitate deposition of sheets or inserts 12IS (shown as dashed lines) by one of the feed mechanisms, the controller 56 may increase the speed of the registration belt 46R to open or increase the spacing of the pocket PK. As such, the increased pocket size provides an unobstructed area for laying sheets or inserts onto the collation 12C.

Before passing beneath another of the feed mechanisms, the controller 56 may increase the speed of the conveyor belt 46C relative to the registration belt 46R, or alternatively, decrease the speed of the registration belt 46R relative to the conveyor belt 46C, to close or decrease the spacing of the pocket PK. By reducing the pocket size, the fingers 46FT, 46FR jog the leading and trailing edges 12EL, 12ET to align the sheets of the collation 12C. This cycle may repeat for as many feed mechanisms as the chassis module 40 contains. Alternatively, the pocket spacing may remain one dimension, e.g., oversized, relative to the corresponding dimension of the collation 12C until all additional sheets or inserts 12IS are deposited by the feed mechanisms. After depositing all of the sheets or inserts 12IS, the relative spacing between the fingers 46FT, 46FR may close to jog and align the leading and trailing edges 12EL, 12ET of all collations 12C on the transport deck. In this embodiment, registration walls 58 may be disposed along each side of the transport deck 44 to guide and align the side edges 12SE of the collation 12C.

While accurate control and alignment of the sheet material 12 is generally desirable for any material handling operation, the independent control of the conveyor and registration belts enables the chassis module 40 to be operated in different modes. Without distinguishing the function of the belts 46C, 46R as being one used for transport or registration, the relative position of the belts 46C, 46R may be phased to produce additional pockets to handle additional collations 12C. As such, increased efficiency may be achieved. For example, by positioning the fingers 46FR of a first pair of belts, e.g., the innermost belts 46R, midway between the fingers 46FT-A, 46FT-B of a second pair of belts, e.g., the outermost belts 46C, two (2) pockets PK-1, PK-2 may be created in place of a single pocket. That is, in one operational mode, a large pocket PK may be required to handle sheet material of a first dimension whereas, in a second operational mode, a smaller pockets PK-1, PK-2, e.g., ½ the size of the first, may be used to handle or accept sheet material of a second dimension. Consequently, by shifting or phasing the relative position of the fingers, a greater or smaller number of pockets may be produced. In this embodiment, the fingers dually function to convey and align the sheet material, albeit the requirement for jogging or oscillatory motion may no longer be necessary or desired.

In summary, the transport and alignment system 20 of the present invention provides controlled displacement of the conveyor and registration chains/belts to transport sheet material while additionally or concurrently aligning the edges thereof. Further, the transport and alignment system minimizes the number of moving parts and/or the need for independent mechanisms, e.g., prior art swing arms, solenoid activated stops, or dedicated jogging stations, to align the edges of a sheet material. The invention provides additional functionality by uniquely controlling common components, i.e., chains/belts typically employed in transport mechanisms. Consequently, the invention may be implemented and practiced with relatively minor structural modification to pre-existing transport mechanisms and/or equipment.

Additionally, the transport and alignment system 20 of the present invention facilitates the initial set-up and dimension requirements for the sheet material pocket. Simple control inputs can be made by the controllers 36, 56 to establish the initial dimensions of the pocket. More specifically, the controllers 36, 56 may be programmed, through software inputs, to establish or change the relative spacing between the transport and registration fingers. In contrast, the prior art transport and alignment systems typically rely upon laborious/painstaking adjustments of various components e.g., the pusher fingers and stop mechanisms to establish or vary the pocket size. Each time that sheet material of different dimensions is processed, an operator is required to manually set or move the position of pusher fingers, swing arms and stops. The present invention, on the other hand, eliminates these labor requirements by programming/software modifications.

Along the same lines discussed in the preceding paragraph, the transport and alignment system facilitates multiple operating modes. That is, by varying the relative position of the fingers, multiple pockets for accepting sheet material may be created. Finally, the transport and alignment system provides for nearly infinite adjustment of the pocket size. Whereas, in the prior art, finite or incremental adjustment of the pocket size is made possible through manual adjustment, the present invention enables fine differential adjustments of the position and/or speed of the belts for virtually infinite adjustment of the pocket size. Furthermore, such adjustments can be made through software algorithms/programming logic run and controlled by the motor controllers.

While the transport and alignment system has been described in the context of a stitcher and chassis module of a mailpiece inserter system, it will be appreciated that the transport and alignment system is applicable to any sheet material handling system. Furthermore, while two pairs of conveyor drive and registrations chains/belts are shown, a single pair of chains/belts may be employed depending upon the alignment capability of the transport and registration fingers. Conversely, a greater number of paired chains/belts may be employed if, for example, larger size sheet material is handled. Furthermore, while the transport and registrations fingers are shown to be equally-spaced along each chain or belt, the spacing between each finger may vary depending upon the spacing of the feeding mechanisms and/or the timing established for laying sheet material. Moreover, while a rectangular shaped chain/belt configuration is shown, the configuration may have any shape provided that a portion of the chain/belt is substantially parallel to the support deck. Hence, an elliptical, triangular, trapezoidal or other polygon shape may be employed.

It is to be understood that the present invention is not to be considered as limited to the specific embodiments described above and shown in the accompanying drawings. The illustrations merely show the best mode presently contemplated for carrying out the invention, and which is susceptible to such changes as may be obvious to one skilled in the art. The invention is intended to cover all such variations, modifications and equivalents thereof as may be deemed to be within the scope of the claims appended hereto.

What is claimed is:

1. A transport and alignment system for handling stacked sheet material on a support deck, comprising:

first and second belts each having a plurality of spaced-apart fingers, a portion of each belt disposed adjacent and parallel to the support deck, the fingers engaging opposed edges of the sheet material, and, a drive mechanism for independently driving the first and second belts along the support deck, the drive mechanism effecting concurrent and relative motion of the fingers, the drive mechanism including drive and idler wheels for driving and supporting each of the first and second belts, the drive wheel of one belt being co-axially aligned with the idler wheel of the other belt, whereby concurrent motion of the fingers transports the stacked sheet material along the support deck and relative motion of the fingers jogs the sheet material to align the opposed edges of the stacked sheets of material.

2. The transport and alignment system according to claim 1 wherein the first belt is a conveyor belt and the second belt is a registration belt, and further comprising two pairs of pairs of conveyor and registration belts wherein the first and second plurality of fingers thereof define a rectangular shaped pocket therebetween.

3. The transport and alignment system according to claim 2 wherein the pocket has a pocket dimension, and wherein the drive mechanism effects relative motion of the fingers to increase the pocket size to facilitate placement of the stacked sheet material.

4. The transport and alignment system according to claim 2 wherein the pocket has a pocket dimension, and wherein the drive mechanism effects relative motion of the fingers to decrease the pocket size to jog the opposed edges of the stacked sheet material into alignment.

5. The transport and alignment system according to claim 2 wherein a surface of the first and second belts defines the deck for supporting the stacked sheet material.

6. The transport and alignment system according to claim 1 wherein the drive mechanism includes drive and idler wheels for driving and supporting each of the first and second belts, the belts disposed about the drive and idler wheels to define in a polygon-shape.

7. The transport and alignment system according to claim 6 wherein the drive wheel of one belt is co-axially aligned with the idler wheel of the other belt.

8. The transport and alignment system according to claim 1 wherein the drive mechanism effects phased positioning of the fingers to produce multiple pockets for accepting the sheet material.

9. The transport and alignment system according to claim 1 wherein the drive mechanism effects combined concurrent and oscillatory motion of the fingers to align the edges of the stacked sheet material during transport of the sheet material.

10. A stitcher module for a mail piece inserter, the module binding stacked sheet material, comprising:

a frame support;

a deck mounting in combination with the frame for supporting the stacked sheet material; first and second pairs of chains, each pair including a conveyor and registration chain, each chain having a portion thereof disposed parallel to the support deck and including a plurality of spaced-apart fingers, the fingers defining a pocket therebetween to accept the stacked sheet material and engaging opposed edges thereof, a drive mechanism including a first drive motor, a second drive motor and a controller, the first drive motor coupled to the frame for driving the conveyor chains along the support deck; the second drive motor coupled to the frame for driving the registration chains along the support deck, and, the controller issuing command signals to the drive motors to drive the conveyor and registration chains, the chains being driven, in a first operating mode, to effect relative motion of the fingers to jog the edges of the stacked sheet into alignment and, in a second operating mode, to effect concurrent motion of the fingers to transport the stacked sheet material along the support deck;

the drive mechanism further including drive and idler sprockets for driving and supporting each of the conveyor and registration chains, and wherein the drive sprockets of one of the chains are co-axially aligned with the idler sprockets of the other of the chains, and a stitching mechanism coupled to the support deck for binding the stack sheet material following the first operating mode.

11. The stitcher according to claim 10 wherein the drive sprockets define a rotational axis and further comprising a jogger disc rotating about an axis parallel to the rotational axis of the drive sprocket, the jogger disc further defining a cam surface abutting a side edge of the sheet material such that upon rotation of the disc, the cam surface effects lateral displacement of the stacked sheet material to jog the side edges into alignment.

12. A chassis module for a mail piece inserter, the module for adding inserts to a sheet material collation, comprising:

a frame support;

first and second pairs of belts, each pair including a conveyor drive and registration belt, each belt having a portion thereof disposed parallel to the feed path of the sheet material collation and including a plurality of spaced-apart fingers, the fingers defining a pocket therebetween to accept the stacked sheet material and engaging opposed edges thereof, a drive mechanism including a first drive motor, a second drive motor and a controller, the first drive motor coupled to the frame for driving the conveyor belts along the feed path; the second drive motor coupled to the frame for driving the registration belts along the feed path, and, the controller issuing command signals to the drive motors to drive the conveyor and registration belts, the drive mechanism further including drive and idler wheels for driving and supporting each of the conveyor and registration belts, and wherein the drive wheels of one of the belts are co-axially aligned with the idler wheels of the other of the belts at least one feeding mechanism disposed above the frame depositing inserts into the pockets defined by the fingers, the belts being driven to effect to effect concurrent and relative motion of the fingers to transport the stacked sheet material along the feed path, facilitate deposition of the sheet material by the feeding mechanism into the pocket and jog the opposed edges of the sheet material into alignment.

13. The chassis module according to claim 12 wherein the pocket has a pocket dimension, and wherein the belts are driven to effect relative motion of the fingers to increase the pocket size to facilitate placement of the stacked sheet material into the pocket.

14. The chassis module according to claim 12 wherein the pocket has a pocket dimension, and wherein the belts are driven to effect relative motion of the fingers to decrease the pocket size to jog the opposed edges of the sheet material into alignment.

15. The chassis module according to claim 12 wherein the belts are driven such that the fingers of one belt is out of phase with the fingers of the other belt to increase the number of pockets available to accept sheet material.

* * * * *

UNITED STATES PATENT AND TRADEMARK OFFICE

CERTIFICATE OF CORRECTION

PATENT NO. : 7,588,239 B2
APPLICATION NO. : 11/300260
DATED : September 15, 2009
INVENTOR(S) : Marcinik et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 703 days.

Signed and Sealed this

Twenty-first Day of September, 2010

David J. Kappos

David J. Kappos
*Director of the United States Patent and Trademark Office*